US010344537B2

(12) United States Patent
Gavia et al.

(10) Patent No.: US 10,344,537 B2
(45) Date of Patent: Jul. 9, 2019

(54) EARTH-BORING TOOLS, METHODS OF FORMING EARTH-BORING TOOLS, AND METHODS OF FORMING A BOREHOLE IN A SUBTERRANEAN FORMATION

(71) Applicant: Baker Hughes Incorporated, Houston, TX (US)

(72) Inventors: David Gavia, The Woodlands, TX (US); Kenneth R. Evans, Spring, TX (US); Bibek Ghimire, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 211 days.

(21) Appl. No.: 15/222,508

(22) Filed: Jul. 28, 2016

(65) Prior Publication Data

US 2018/0030787 A1 Feb. 1, 2018

(51) Int. Cl.

| | |
|---|---|
| ***E21B 10/42*** | (2006.01) |
| ***E21B 10/43*** | (2006.01) |
| ***E21B 10/54*** | (2006.01) |

(52) U.S. Cl.

CPC ..... *E21B 10/43* (2013.01); *E21B 10/54* (2013.01); *E21B 2010/425* (2013.01)

(58) Field of Classification Search

CPC ..... E21B 10/43; E21B 10/55; E21B 2010/425

See application file for complete search history.

(56) References Cited

U.S. PATENT DOCUMENTS

| | | | | | |
|---|---|---|---|---|---|
| 4,471,845 | A * | 9/1984 | Jurgens | E21B 10/46 | 175/431 |
| 5,033,560 | A * | 7/1991 | Sawyer | E21B 10/43 | 175/415 |
| 5,238,075 | A * | 8/1993 | Keith | E21B 10/55 | 175/431 |
| 5,549,171 | A * | 8/1996 | Mensa-Wilmot | E21B 10/43 | 175/431 |
| 5,551,522 | A | 9/1996 | Keith et al. | | |
| 5,582,261 | A * | 12/1996 | Keith | E21B 10/43 | 175/431 |
| 5,592,996 | A * | 1/1997 | Keith | E21B 10/55 | 175/430 |
| 5,607,025 | A * | 3/1997 | Mensa-Wilmot | E21B 10/43 | 175/431 |
| 5,816,346 | A * | 10/1998 | Beaton | E21B 10/43 | 175/431 |
| 6,123,161 | A * | 9/2000 | Taylor | E21B 10/55 | 175/397 |
| 7,896,106 | B2 | 3/2011 | Gavia | | |

(Continued)

*Primary Examiner* — Jennifer H Gay

(74) *Attorney, Agent, or Firm* — TraskBritt

(57) ABSTRACT

An earth-boring tool comprises a body, a plurality of blades, and cutting elements. The body has a face at a leading end thereof and comprises a cone region, a nose region, a flank region, a shoulder region, and a gage region. The plurality of blades extends longitudinally and radially over the face. The cutting elements are disposed within the shoulder region of the body on different blades of the plurality of blades than one another, a first of the cutting elements exhibiting a different size than a second of the cutting elements. A method of forming an earth-boring tool and a method of forming a borehole in a subterranean formation are also described.

17 Claims, 6 Drawing Sheets

(56) References Cited

U.S. PATENT DOCUMENTS

| | | | | |
|---|---|---|---|---|
| 2007/0240905 | A1* | 10/2007 | Mensa-Wilmot | E21B 10/567 175/57 |
| 2008/0135297 | A1* | 6/2008 | Gavia | E21B 10/43 175/57 |
| 2008/0179108 | A1* | 7/2008 | McClain | E21B 10/43 175/431 |
| 2009/0145669 | A1* | 6/2009 | Durairajan | E21B 10/43 175/431 |
| 2009/0266619 | A1* | 10/2009 | Durairajan | E21B 10/43 175/431 |
| 2011/0073369 | A1* | 3/2011 | Vempati | E21B 10/43 175/57 |
| 2011/0155472 | A1* | 6/2011 | Lyons | E21B 10/55 175/331 |
| 2012/0138365 | A1* | 6/2012 | Maurstad | E21B 10/43 175/57 |
| 2015/0233185 | A1* | 8/2015 | Maouche | E21B 10/43 175/431 |
| 2016/0032655 | A1* | 2/2016 | Boehm | E21B 10/55 175/57 |
| 2018/0030787 | A1* | 2/2018 | Gavia | E21B 10/43 |

* cited by examiner

EARTH-BORING TOOLS, METHODS OF FORMING EARTH-BORING TOOLS, AND METHODS OF FORMING A BOREHOLE IN A SUBTERRANEAN FORMATION

TECHNICAL FIELD

The disclosure relates generally to earth-boring tools, to methods of forming earth-boring tools, and to methods of forming a borehole in a subterranean formation. More particularly, embodiments of the disclosure relate to earth-boring tools exhibiting favorable cutting efficiency, force distribution, and damage distribution during drilling operations, and to methods of forming and using such earth-boring tools.

BACKGROUND

Boreholes are formed in subterranean formations for various purposes including, for example, extraction of oil and gas from the subterranean formations and extraction of geothermal heat from the subterranean formations. A borehole may be formed in a subterranean formation using a drilling assembly including an earth-boring tool, such as a rotary drill bit, coupled to a distal end of a drill string that includes a series of elongated tubular segments connected end-to-end and extending into the wellbore from the surface of the subterranean formation.

Non-limiting examples of rotary drill bits include fixed-cutter drill bits (also known in the art as "drag" bits), roller cone drill bits (also known in the art as "rock" bits), diamond-impregnated bits, and hybrid bits (which may include, for example, both fixed-cutters and roller cone cutters). The rotary drill bit can, for example, be a fixed-cutter drill bit, which typically includes a plurality of blades each carrying multiple cutting elements configured and positioned to cut, crush, shear, and/or abrade away material of the subterranean formation as the rotary drill bit is rotated under an applied axial force (known in the art as "weight-on-bit" (WOB)) to form a borehole therein. Fixed-cutter drill bits have proven very effective in achieving high rates of penetration (ROP) in drilling subterranean formations exhibiting low to medium hardness.

Cutting elements are typically laid out on a fixed-cutter drill bit in a configuration resulting in the formation of progressively smaller helical grooves in a radially outwardly extending direction as the fixed-cutter drill bit is used to form a borehole in the subterranean formation. The geometric configurations (e.g., sizes, shapes) and layout (e.g., positions, spacing) of the cutting elements within at least a shoulder region of a conventional fixed-cutter drill bit frequently results in a single cutting element performing substantially all of the work of forming the outermost diameter of the borehole. Such geometric configurations and layouts can be inefficient to produce boreholes exhibiting desirable outermost diameters, and can result in an undesirably short operational life of the fixed-cutter drill bit.

Accordingly, it would be desirable to have earth-boring tools (e.g., rotary drill bits), methods of forming earth-boring tools, and methods of forming a borehole in a subterranean formation facilitating enhanced efficiency, and prolonged operational life during drilling operations as compared to conventional earth-boring tools, methods of forming earth-boring tools, and methods of forming a borehole in a subterranean formation.

BRIEF SUMMARY

In some embodiments, an earth-boring tool comprises a body, a plurality of blades, and cutting elements. The body has a face at a leading end thereof and comprises a cone region, a nose region, a flank region, a shoulder region, and a gage region. The plurality of blades extends longitudinally and radially over the face. The cutting elements are disposed within the shoulder region of the body on different blades of the plurality of blades than one another, a first of the cutting elements exhibiting a different size than a second of the cutting elements.

In additional embodiments, a method of forming an earth-boring tool comprises forming a body having a face at a leading end thereof and comprising a cone region, a nose region, a flank region, a shoulder region, and a gage region. A first cutting element is disposed within the shoulder region of the body on a first blade extending longitudinally and radially over the face. A second cutting element is disposed within the shoulder region of the body on a second blade extending longitudinally and radially over the face and rotationally trailing the first blade, the second cutting element exhibiting a different size than the first cutting element.

In further embodiments, a method of forming a borehole in a subterranean formation comprises disposing an earth-boring tool at a distal end of a drill string in a borehole in a subterranean formation, the earth-boring tool comprising a body, a plurality of blades, and cutting elements. The body has a face at a leading end thereof and comprises a cone region, a nose region, a flank region, a shoulder region, and a gage region. The plurality of blades extends longitudinally and radially over the face. The cutting elements are disposed within the shoulder region of the body on different blades of the plurality of blades than one another, a first of the cutting elements exhibiting a different size than a second of the cutting elements. Weight on bit is applied to the earth-boring tool through the drill string to contact the formation while rotating the earth-boring tool. The subterranean formation is engaged with the cutting elements of the rotating earth-boring tool.

DETAILED DESCRIPTION

Figure 1A:
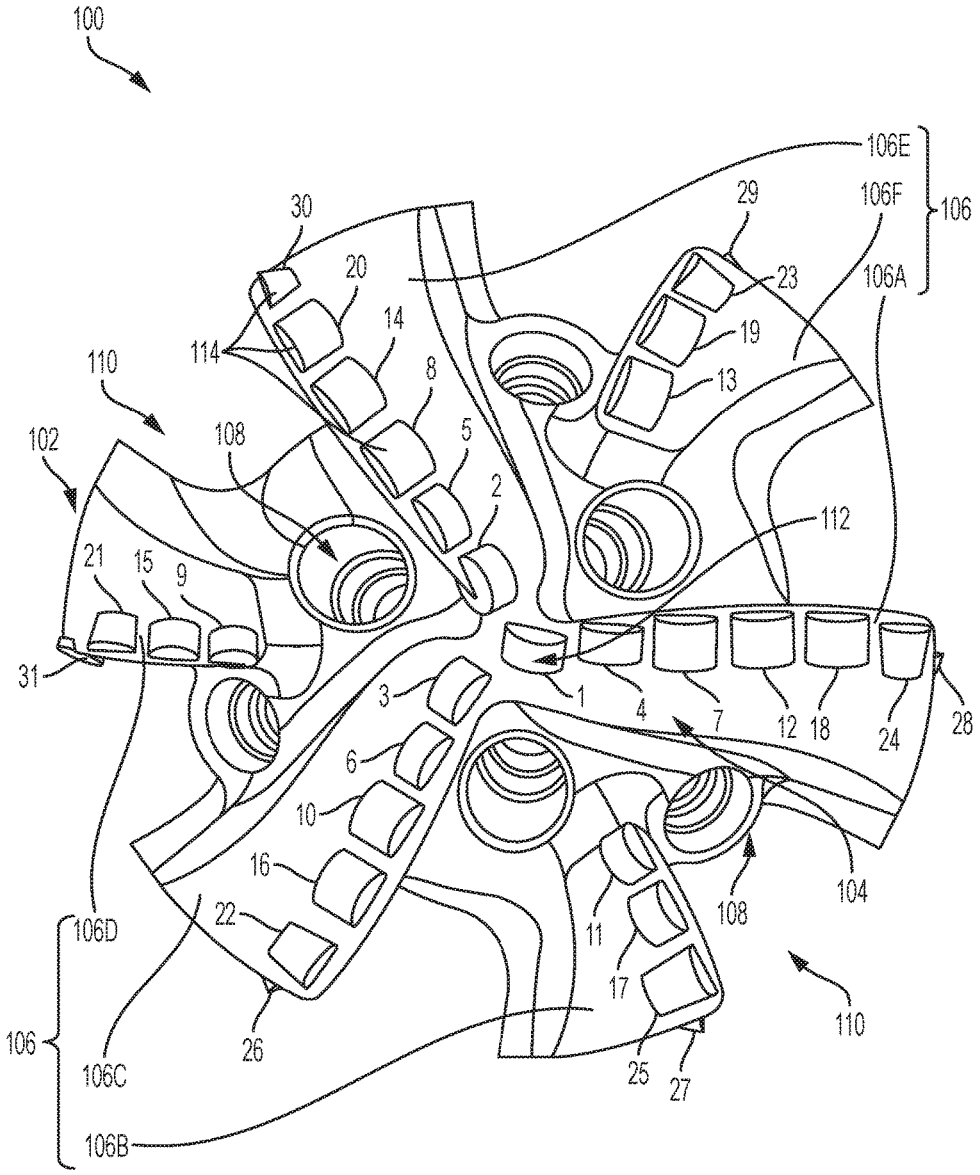
FIG. 1A is a face view of a rotary drill bit, in accordance with an embodiment of the disclosure.

Earth-boring tools are disclosed, as are methods of forming earth-boring tools, and methods of forming a borehole in a subterranean formation. In some embodiments, an earth-boring tool includes a body (e.g., bit body) having a face (e.g., bit face) at a leading end thereof, and a plurality of blades extending longitudinally and radially over the face of the body. The body may include a rotational axis, a cone region outwardly radially adjacent the rotational axis, a nose region outwardly radially adjacent the cone region, a flank region outwardly radially adjacent the nose region, a shoulder region outwardly radially adjacent the flank region, and a gage region outwardly radially adjacent the shoulder region. Cutting elements are disposed within the shoulder region of the body on different blades than one another. At least one of the cutting elements exhibits a different size (e.g., a different diameter, a different lateral extent) and a different radial position within the shoulder region of the body than at least one other of the cutting elements. The configurations (e.g., sizes, shapes, material compositions) and layout (e.g., positions, spacing) of the cutting elements may facilitate the more efficient formation of a borehole in a subterranean formation as compared to conventional cutting element configurations and layouts employed in conventional earth-boring tools.

The following description provides specific details, such as material types and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure (e.g., cutting element), tool, or assembly. Only those process acts and structures necessary to understand the embodiments of the disclosure are described in detail below. Additional acts to form the complete structure, the complete tool, or the complete assembly from various structures may be performed by conventional fabrication techniques. The drawings accompanying the present application are for illustrative purposes only, and are not drawn to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, and arrangement of one or more of at least one structure and at least one apparatus facilitating operation of one or more of the structure and the apparatus in a pre-determined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

FIG. 1A is a face view of a rotary drill bit 100 in the form of a fixed cutter or so-called "drag" bit, according to an embodiment of the disclosure. The rotary drill bit 100 includes a body 102 exhibiting a face 104 defined by external surfaces of the body 102 that contact a subterranean formation during drilling operations. The body 102 may comprise, by way of example and not limitation, an infiltrated tungsten carbide body, a steel body, or a sintered particle matrix body, and may include a plurality of blades 106 extending longitudinally and radially over the face 104 in a spiraling configuration relative to a rotational axis 112 of the rotary drill bit 100. The blades 106 may receive and hold cutting elements 114 (numbered from 1 to 31), and may define fluid courses 108 therebetween extending into junk slots 110 between gage sections of circumferentially adjacent blades 106. In some embodiments, the body 102 includes an even number of the blades 106, such as greater than or equal to four of the blades 106 (e.g., four of the blades 106, six of the blades 106, eight of the blades 106). For example, as depicted in FIG. 1A, the body 102 may include six (6) of the blades 106. In additional embodiments, the body 102 includes a different quantity (e.g., number, amount) of the blades 106. The body 102 may include, for example, an odd number of the blades 106 (e.g., five of the blades 106; seven of the blades 106). Accordingly, while various embodiments herein describe or illustrate the body 102 as including the six (6) blades 106A-106F, the body 102 may, alternatively, include a different number of the blades 106.

As shown in FIG. 1A, the blades 106 may include primary blades 106A, 106C, 106E, and secondary blades 106B, 106D, 106F. At least a portion (e.g., each) of the primary blades 106A, 106C, 106E may be circumferentially separated from one another by the secondary blades 106B, 106D, 106F, and may each include a first end located radially proximate the rotational axis 112 of the rotary drill bit 100. In addition, at least a portion (e.g., each) of the secondary blades 106B, 106D, 106F may be circumferentially separated from one another primary blades 106A, 106C, 106E, and may each include a first end located more radially distal from the rotational axis 112 of the rotary drill bit 100 than the first end of each of the primary blades 106A, 106C, 106E. As shown in FIG. 1A, the primary blades 106A, 106C, 106E may circumferentially alternate with the secondary blades 106B, 106D, 106F around the face 104 of the rotary drill bit 100. A first primary blade 106A may be circumferentially separated from a second primary blade 106C by a first secondary blade 106B, the second primary blade 106C may be circumferentially separated from a third primary blade 106E by a second secondary blade 106D, and the third primary blade 106E may be circumferentially separated from the first primary blade 106A by a third secondary blade 106F. In additional embodiments, such as in embodiments wherein the body 102 exhibits a different number of the blades 106, the body 102 may exhibit a different quantity and/or a different circumferential sequence (e.g., circumferential pattern) of primary blades and secondary blades. The body 102 may include, for example, an even number of primary blades circumferentially alternating with an even number of secondary blades (e.g., two primary blades circumferentially alternating with two secondary blades, four primary blades circumferentially alternating with four secondary blades), an odd number of primary blades at least partially circumferentially alternating with an even number of secondary blades (e.g., three primary blades circumferentially alternating with two secondary blades, three primary blades partially circumferentially alternating with four secondary blades), or an even number of primary blades at least partially circumferentially alternating with an odd number of secondary blades (e.g., two primary blades circumferentially alternating with three secondary blades, four primary blades partially circumferentially alternating with three secondary blades). Accordingly, while various embodiments herein describe or illustrate the body 102 as including three (3) primary blades 106A, 106C, 106E circumferentially alternating with three (3) secondary blades 106B, 106D, 106F, the body 102 may, alternatively, include a different quantity and/or a different sequence of primary blades and secondary blades.

The cutting elements 114 may comprise a superabrasive (e.g., diamond) mass bonded to a supporting substrate. For example, at least some of the cutting elements 114 may be formed of and include a disc-shaped diamond "table" having a cutting face formed on and bonded under an ultra-high-pressure and high-temperature (HPHT) process to a supporting substrate formed of cemented tungsten carbide. Other known cutting face configurations may also be employed in implementation of embodiments of the disclosure. The cutting elements 114 may be affixed to the blades 106 through brazing, welding, or any other suitable means. The cutting elements 114 may be backraked at a common angle, or at varying angles. In addition, the cutting elements 114 may independently be formed of and include suitably mounted and exposed natural diamonds, thermally stable polycrystalline diamond compacts, cubic boron nitride compacts, tungsten carbide, diamond grit-impregnated segments, or combinations thereof. The material composition of the cutting elements 114 may be selected at least partially based on the hardness and abrasiveness of the subterranean formation to be drilled.

Figure 1B:
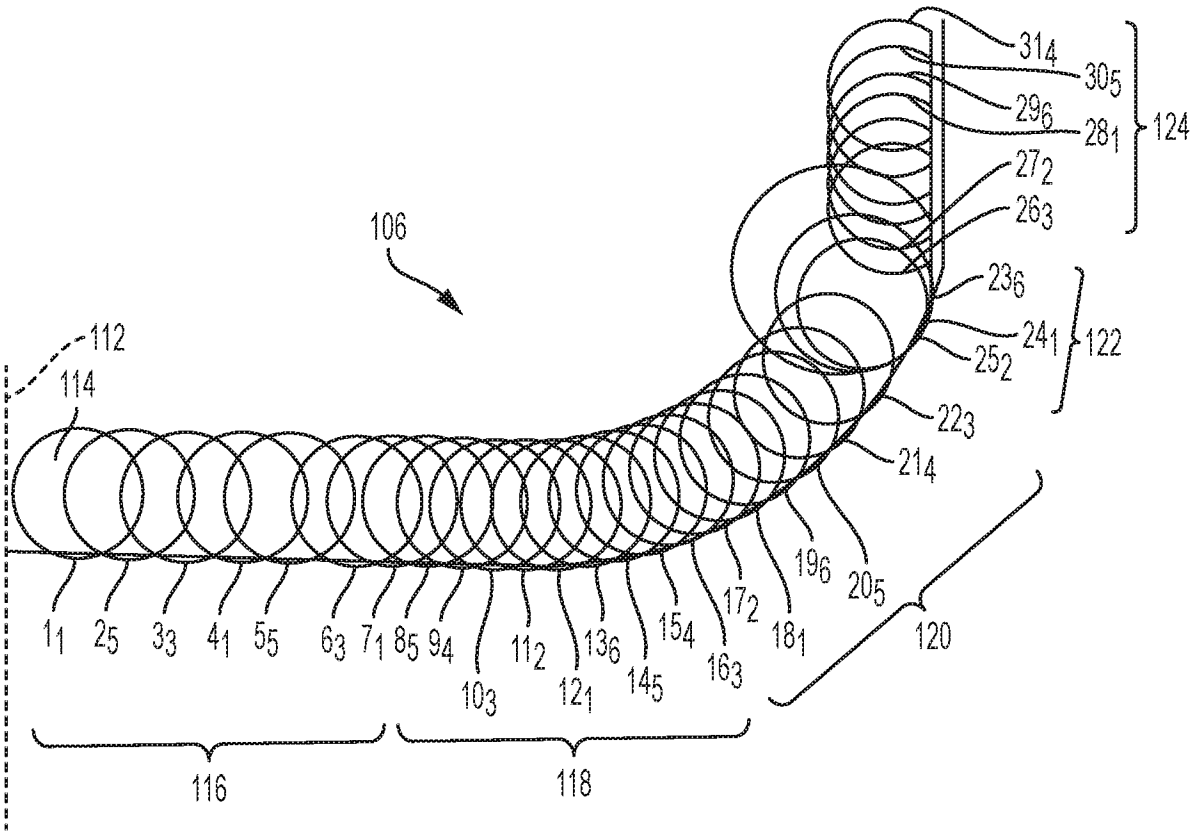
FIG. 1B is a cutter and blade profile for the rotary drill bit shown in FIG. 1A.

The cutting elements 114 are positioned and sized on the blades 106 to provide enhanced cutting efficiency, to more evenly distribute damage (e.g., dulling) across the cutting elements 114, and to extend the life of the rotary drill bit 100 during drilling operations (e.g., drilling of a homogeneous subterranean formation; drilling of a heterogeneous subterranean formation, such as a subterranean formation including transitions between a soft material and a hard material) as compared to conventional cutting element layouts. FIG. 1B shows a cutter and blade profile of the rotary drill bit 100 (FIG. 1A) as if each of the cutting elements 114 disposed on the various blades 106 was rotated about the rotational axis 112 onto a single blade 106. As shown in FIG. 1B, the cutting elements 114 are positioned on the blades 106 and are numbered from 1 to 31 sequentially in the radial direction. The numbering scheme shown correlates to the radial position of the cutting elements 114 with relation to the rotational axis 112 of the rotary drill bit 100. For example, the cutting element 114 identified by the number one (1) is the cutting element 114 closest to the rotational axis 112, while the cutting element 114 identified by the number 31 is positioned farthest from the rotational axis 112. In additional embodiments, the blades 106 may include a different quantity of the cutting elements 114, such as greater than 31 of the cutting elements 114, or less than 31 of the cutting elements 114. Furthermore, in FIG. 1B, the subscript number provided on the number identifying each of the cutting elements 114 correlates to the blade 106 upon which a particular cutting element 114 is located. The subscript number 1 corresponds to the first primary blade 106A, the subscript number 2 corresponds to the first secondary blade 106B, the subscript number 3 corresponds to the second primary blade 106C, the subscript number 4 corresponds to the second secondary blade 106D, the subscript number 5 corresponds to the third primary blade 106E, and the subscript number 6 corresponds to the third secondary blade 106F. For example, "$1_1$" indicates that the cutting element 114 identified by the number 1 is located on the first primary blade 106A, "$2_5$" indicates that the cutting element 114 identified by the number 2 is located on the third primary blade 106E, "$3_3$" indicates that the cutting element 114 identified by the number 3 is located on the second primary blade 106C, "$9_4$" indicates that the cutting element 114 identified by the number 10 is located on the second secondary blade 106D, "$11_2$" indicates that the cutting element 114 identified by the number 11 is located on the first secondary blade 106B, "$13_6$" indicates that the cutting element 114 identified by the number 12 is located on the third secondary blade 106F, etc.

Referring to FIG. 1B, the cutting elements 114 may be positioned (e.g., disposed, located) within different regions of the body 102 (FIG. 1A). A first portion of the cutting elements 114 may be positioned within a cone region 116 outwardly radially adjacent the rotational axis 112, a second portion of the cutting elements 114 may be positioned within a nose region 118 outwardly radially adjacent the cone region 116, a third portion of the cutting elements 114 may be positioned within a flank region 120 outwardly radially adjacent the nose region 118, a fourth portion of the cutting elements 114 may be positioned within a shoulder region 122 outwardly radially adjacent the flank region 120, and a fifth portion of the cutting elements 114 may be positioned within a gage region 124 outwardly radially adjacent the shoulder region 122. By way of non-limiting example, as shown in FIG. 1B, the cuffing elements 114 identified by numbers 1 through 6 may be positioned within the cone region 116; the cutting elements 114 identified by numbers 7 through 15 may be positioned within the nose region 118; the cutting elements 114 identified by numbers 16 through 22 may be positioned within the flank region 120; the cutting elements 114 identified by numbers 23 through 25 may be positioned within the shoulder region 122; and the cutting element 114 identified by numbers 26 through 31 may be positioned within the gage region 124.

In additional embodiments, the body 102 (FIG. 1A) may exhibit one or more of a different quantity and a different arrangement of the cutting elements 114 in one or more of the different regions thereof. One or more of the different regions may, for example, exhibit a greater quantity of the cutting elements 114, a lower quantity of cutting elements 114, closer radial spacing (e.g., separation) between at least some of the cutting elements 114, and/or farther radial spacing between at least some of the cutting elements 114. By way of non-limiting example, the shoulder region 122 may exhibit greater than three (3) cutting elements 114 therein, or less than three (3) cutting elements 114 therein. The quantity of cutting elements 114 included in the shoulder region 122 may be within a range of from one (1) to a number corresponding to (e.g., the same as) the total number of blades 106 included in the body 102. For example, in embodiments where the body 102 includes six (6) blades 106, the shoulder region 122 may include from one (1) cutting element 114 to six (6) cutting elements 114. As another example, in embodiments where the body 102 includes four (4) blades 106, the shoulder region 122 may include from one (1) cutting element 114 to four (4) cutting elements 114. Accordingly, while various embodiments herein describe or illustrate the different regions of the body 102 as including particular quantities and particular arrangements of the cutting elements 114, one or more of the different regions (e.g., the shoulder region 122) of the body 102 may, alternatively, include one or more of a different quantity and different arrangement of the cutting elements 114 therein.

Referring collectively to FIGS. 1A and 1B, the cutting elements 114 in one or more of the different regions of the body 102 (FIG. 1A) may independently be disposed on any desired combination of the primary blades 106A, 106C, 106E (FIG. 1A) and the secondary blades 106B, 106D, 106F (FIG. 1A). For example, if the shoulder region 122 (FIG. 1B) includes three (3) of the cutting elements 114 (e.g., the cutting elements 114 identified by numbers 23, 24, and 25), one (1) of the cutting elements 114 (e.g., the cutting element 114 identified by the number 24) may be located on one of the primary blades 106A, 106C, 106E (e.g., the first primary blade 106A), and two (2) of the cutting elements 114 (e.g., the cutting elements 114 identified by the numbers 23 and 25) may be located on two (2) of the secondary blades 106B, 106D, 106F (e.g., the first secondary blade 106B and the third secondary blade 106F) circumferentially adjacent the one (1) of the primary blades 106A, 106C, 106E. In additional embodiments, one (1) of the cutting elements 114 may be located on one (1) of the secondary blades 106B, 106D, 106F, and two (2) of the cutting elements 114 may be located on two (2) of the primary blades 106A, 106C, 106E circumferentially adjacent the one (1) of the secondary blades 106B, 106D, 106F. In further embodiments, such as in embodiments within the body 102 includes a different quantity of the blades 106 (e.g., e.g., a different quantity of primary blades and/or a different quantity of secondary blades) and/or a different quantity of the cutting elements 114 in the shoulder region 122, the cutting elements 114 within the shoulder region 122 may be disposed on primary blades (e.g., the primary blades 106A, 106C, 106E) and/or secondary blades (e.g., the secondary blades 106B, 106D, 106F) in a different arrangement that that depicted in FIGS. 1A and 1B.

The cutting elements 114 may be provided on the blades 106 in any desired spiral configuration, such as a reverse spiral configuration, a forward spiral configuration, or a combination thereof. As used herein, the term "reverse spiral configuration" means and includes a configuration wherein neighboring cutting elements are positioned on an earth-boring tool (e.g., a rotary drill bit) so as to form an arcuate (e.g., curved) path extending from a cutting element more radially proximate a rotational axis of the earth-boring tool to another cutting element more radially distal from the rotational axis in the rotational direction of the earth-boring tool. For example, a first cutting element may be positioned on a first of the blades 106, and a second cutting element radially adjacent the first cutting element, but radially distal from the rotational axis 112 of the rotary drill bit 100 relative to the first cutting element, may be positioned on a second of the blades 106 that rotationally leads the first of the blades 106. Conversely, as used herein, the term "forward spiral configuration" means and includes a configuration wherein neighboring cutting elements are positioned on an earth-boring tool (e.g., a rotary drill bit) so as to form an arcuate path extending from a cutting element more radially proximate a rotational axis of the earth-boring tool bit to another cutting element more radially distal from the rotational axis in a direction opposite (e.g., against) the rotational direction of the earth-boring tool. For example, a first cutting element may be positioned on a first of the blades 106, and a second cutting element radially adjacent the first cutting element, but radially distal from the rotational axis 112 of the rotary drill bit 100 relative to the first cutting element, may be positioned on a second of the blades 106 that rotationally trails the first of the blades 106. In some embodiments, some of the cutting elements 114 are provided on the blades 106 in a reverse spiral configuration, and other of the cutting elements 114 are provided on the blades 106 in a forward spiral configuration. For example, at least some of the cutting elements 114 provided within one or more of the different regions of the body 102 (e.g., one or more of the cone region 116, the nose region 118, the flank region 120, the shoulder region 122, and the gage region 124 shown in FIG. 1B) may be provided on the blades 106 in a first spiral configuration, and at least some other of the cutting elements 114 provided within one or more other of the different regions of the body 102 (e.g., one or more other of the cone region 116, the nose region 118, the flank region 120, the shoulder region 122, and the gage region 124 shown in FIG. 1B) may be provided on the blades 106 in a second, opposite spiral configuration. As shown in FIGS. 1A and 1B, in some embodiments, the cutting elements 114 (e.g., the cutting elements 114 identified by numbers 23 through 25) within the shoulder region 122 (FIG. 1B) of the body 102 are provided in a forward spiral configuration, and the cutting elements 114 (e.g., the cutting elements 114 identified by numbers 1 through 22 and 26 through 31) within the other regions (e.g., the cone region 116, the nose region 118, the flank region 120, and the gage region 124) of the body 102 are provided in a reverse spiral configuration.

With continued reference to FIGS. 1A and 1B, at least some of the cutting elements 114 located within the shoulder region 122 of the body 102 may exhibit a different size (e.g., diameter, lateral extent) than at least some other of the cutting elements 114 located within the other regions of the body 102. As a non-limiting example, at least a portion (e.g., each) of the cutting elements 114 (e.g., the cutting elements 114 identified by the numbers 23 through 25) located within the shoulder region 122 of the body 102 may exhibit a larger size (e.g., a larger diameter, a larger lateral extent) than at least a portion (e.g., each) of the cutting elements 114 (e.g., the cutting elements 114 identified by the numbers 1 through 22 and 26 through 31) in one or more (e.g., each) of the cone region 116, the nose region 118, the flank region 120, and the gage region 124 of the body 102. In some embodiments, the cutting elements 114 in each of the cone region 116, the nose region 118, the flank region 120, and the gage region 124 of the body 102 exhibit substantially the same size as one another, and at least one of the cutting elements 114 in the shoulder region 122 of the body 102 exhibits at least one size larger than the substantially uniform size of the cutting elements 114 within the other regions of the body 102. As described in further detail below, the sizes and arrangements of the cutting elements 114 within the shoulder region 122 may be selected to control how the cutting elements 114 engage surfaces of a subterranean formation to form a borehole exhibiting desirable dimensions (e.g., a desirable outermost diameter) and to control work rates of the cutting elements 114 within the shoulder region 122.

At least some of the cutting elements 114 within the shoulder region 122 of the body 102 (FIG. 1A) exhibit a different size (e.g., diameter, lateral extent) than at least some other of the cutting elements 114 within the shoulder region 122. For example, as shown in FIG. 1B, the cutting element 114 identified by the number 23 may exhibit a larger diameter than the cutting element 114 identified by the number 24, and the cutting element 114 identified by the number 24 may have a larger diameter than the cutting element 114 identified by the number 23. The size of each of the cutting elements 114 within the shoulder region 122 may be selected at least partially based on a desired engagement of a subterranean formation by the cutting elements 114 during use and operation of the rotary drill bit 100 (FIG. 1A). The sizes of the cutting elements 114 within the shoulder region 122 may be selected relative to one another to facilitate the more efficient formation of a borehole exhibiting a larger outer diameter than would otherwise be formed if the cutting elements 114 within the shoulder region 122 exhibited the substantially the same size as one another and/or substantially the same size as the cutting elements 114 within the other regions of the body 102. A ratio between a size of a first, relatively smaller cutting element 114 within the shoulder region 122 and a size of a second, relatively larger cutting element 114 within the shoulder region 122 may, for example, be within a range of from about 0.32:1 to about 0.84:1. The cutting elements 114 within the shoulder region 122 may exhibit two (2) or more different sizes than one another within a range of about 8 millimeters (mm) to about 25 mm. For example, at least one of the cutting elements 114 within the shoulder region 122 may exhibit a size selected from the group consisting of 8 mm, 11 mm, 13 mm, 16 mm, 19 mm, and 25 mm; and at least one other of the cutting elements 114 within the shoulder region 122 may exhibit a different size selected from the group consisting of 8 mm, 11 mm, 13 mm, 16 mm, 19 mm, and 25 mm. In some embodiments, a first of the cutting elements 114 within the shoulder region 122 exhibits a size of about 16 mm, a second of the cutting elements 114 within the shoulder region 122 exhibits a size of about 19 mm, and a third of the cutting elements 114 within the shoulder region 122 exhibits a size of about 25 mm. In additional embodiments, one or more of the cutting elements 114 within the shoulder region 122 may exhibit a different size within the range of from about 8 mm to about 25 mm so long as at least two (2) of the cutting elements 114 within the shoulder region 122 exhibit different sizes than one another. Table 1 below presents a non-limiting list of cutting element sizes and cutting element size ratios that may be employed in combination within the shoulder region 122 of the body 102.

TABLE 1

Exemplary Cutting Element Sizes and Cutting Element Size Ratios

| | Ratio | | | | |
|---|---|---|---|---|---|
| Cutting Element Size | 11 | 13 | 16 | 19 | 25 |
| 8 | 0.73 | 0.62 | 0.50 | 0.42 | 0.32 |
| 11 | X | 0.85 | 0.69 | 0.58 | 0.44 |
| 13 | X | X | 0.81 | 0.68 | 0.52 |
| 16 | X | X | X | 0.84 | 0.64 |
| 19 | X | X | X | X | 0.76 |
| 25 | X | X | X | X | X |

Each of the cutting elements 114 within the shoulder region 122 of the body 102 may exhibit a different size than each other of the cutting elements 114 within the shoulder region 122 of the body 102. For example, each of the cutting elements 114 identified by the numbers 23 through 25 may exhibit a different size than each other of the cutting elements 114 identified by the numbers 23 through 25. Alternatively, at least one of the cutting elements 114 within the shoulder region 122 of the body 102 may exhibit substantially the same size as at least one other of the cutting elements 114 within the shoulder region 122 of the body 102, so long as at least two (2) of the cutting elements 114 within the shoulder region 122 of the body 102 exhibit different sizes than one another. For example, one (1) of the cutting elements 114 identified by the numbers 23 through 25 may exhibit substantially the same size as one (1) other of the cutting elements 114 identified by the numbers 23 through 25. In some embodiments, each of the cutting elements 114 within the shoulder region 122 of the body 102 exhibits a different size than each other of the cutting elements 114 within the shoulder region 122.

Figure 2:
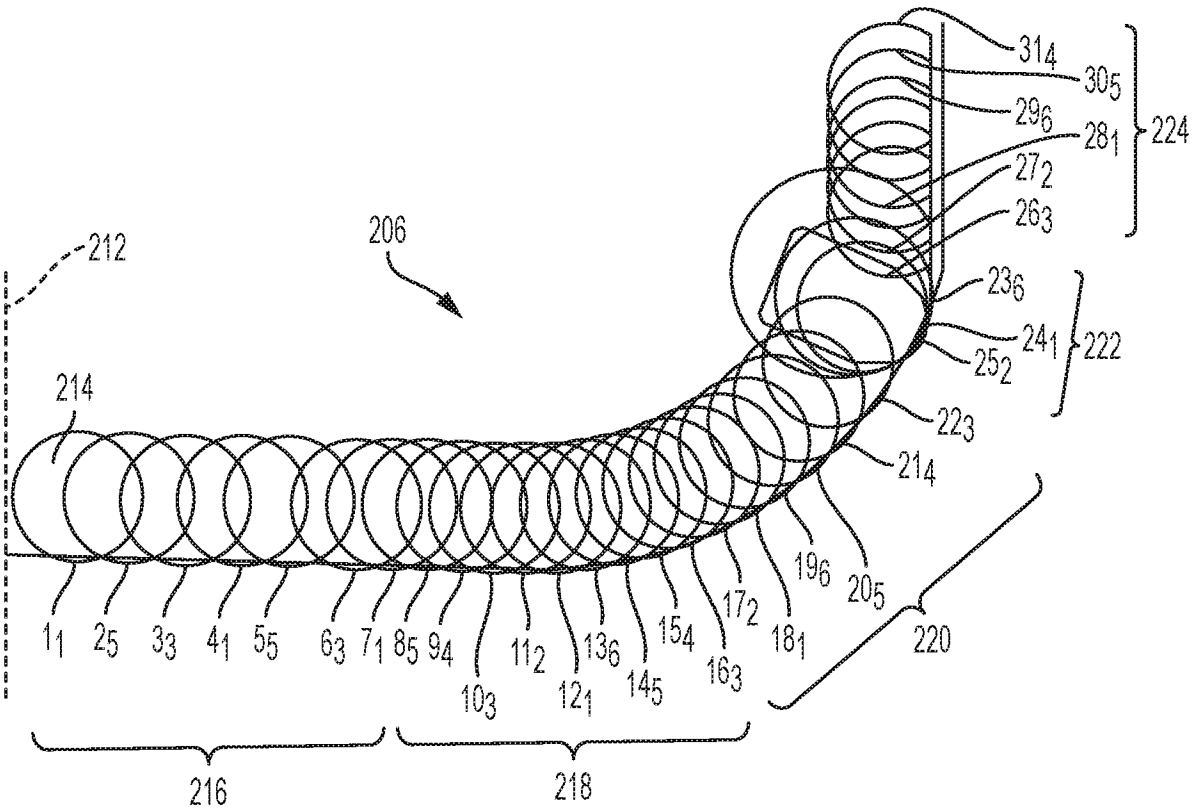
FIG. 2 is a cutter and blade profile of a rotary drill bit, in accordance with another embodiment of the disclosure.

The cutting elements 114 within the shoulder region 122 of the body 102 may each independently exhibit any desired shape, such as a cylindrical shape, a conical shape, a frustoconical shape, truncated versions thereof, or an irregular shape. As shown in FIG. 1A, in some embodiments, each of the cutting elements 114 within the shoulder region 122 (FIG. 1B) independently exhibits a generally cylindrical shape (e.g., a circular cylinder shape). Accordingly, as shown in FIG. 1B, each of the cutting elements 114 within the shoulder region 122 may exhibit a substantially circular cross-sectional shape. In additional embodiments, at least one of the cutting elements 114 within the shoulder region 122 exhibits a different shape. By way of non-limiting example, FIG. 2 shows a cutter and blade profile for a rotary drill bit in accordance with additional embodiments of the disclosure. To avoid repetition, not all features shown in FIG. 2 are described in detail herein. Rather, unless described otherwise below, features designated by a reference numeral that is a 100 increment of the reference numeral of a feature described previously in relation to one or more of FIGS. 1A and 1B will be understood to be substantially similar to the feature described previously. As shown in FIG. 2, at least one of the cutting elements 214 within the shoulder region 222 may exhibit a non-cylindrical shape (e.g., a conical shape, a frustoconical shape, truncated versions thereof, an irregular shape). One or more of the cutting elements 214 within the shoulder region 222 (e.g., the cutting element 214 identified by the number 25) may, for example, exhibit a generally frustoconical shape. In such embodiments, the non-cylindrical shape of one or more of the cutting elements 214 within the shoulder region 222 may facilitate a different type of engagement with a subterranean formation than would otherwise be provided by cutting elements 214 exhibiting generally cylindrical shapes. For example, one or more of the cutting elements 214 exhibiting a non-cylindrical shape may facilitate one or more of crushing and gouging a subterranean formation when the rotary drill bit is rotated under applied force to form or enlarge a borehole, whereas one or more of the cutting elements 214 exhibiting a cylindrical shape may facilitate shearing the subterranean formation when the rotary drill bit is rotated under the applied force.

With returned reference to FIGS. 1A and 1B, the cutting elements 114 within the shoulder region 122 of the body 102 may be provided in any desired arrangement relative to one another. The arrangement of the cutting elements 114 within the shoulder region 122 of the body 102 at least partially depends on a desired work rate of each of the cutting elements 114 within the shoulder region 122 during use and operation of the rotary drill bit 100. For example, the cutting elements 114 within the shoulder region 122 may be radially and circumferentially positioned relative to one another along the body 102 (FIG. 1A) such that each of the cutting elements 114 within the shoulder region 122 at least partially cuts (e.g., shears, gouges, crushes, abrades) a different portion of a subterranean formation to define an outermost diameter of a borehole in the subterranean formation. Put another way, the cutting elements 114 within the shoulder region 122 may be radially and circumferentially positioned relative to one another so as to share the work of forming or enlarging the outermost diameter of the borehole.

In some embodiments, at least one of the cutting elements 114 within the shoulder region 122 exhibiting a relatively larger size (e.g., a relatively larger diameter, a relatively larger lateral extent) is provided at a position that rotationally leads a position of at least one other of the cutting elements 114 within the shoulder region 122 exhibiting a relatively smaller size (e.g., a relatively smaller diameter, a relatively smaller lateral extent) during use and operation of the rotary drill bit 100 (FIG. 1A). By way of non-limiting example, the cutting element 114 identified by the number 23 may be relatively larger than and may rotationally lead the cutting element 114 identified by the number 24, and the cutting element 114 identified by the number 24 may be relatively larger than and may rotationally lead the cutting element 114 identified by the number 25. Each relatively larger cutting element 114 within the shoulder region 122 may be positioned directly radially adjacent a relatively smaller cutting element 114 rotationally trailing the relatively larger cutting element 114; or at least one relatively larger cutting element 114 within the shoulder region 122 may be radially separated from at least one relatively smaller cutting element 114 rotationally trailing the relatively larger cutting element 114 by at least one other cutting element 114 exhibiting a size greater than or equal to that of the relatively larger cutting element 114. As used herein, cutting elements that are "directly radially adjacent" one another refers to cutting elements radially neighboring one another on a face profile of a rotary drill bit without another cutting element radially positioned therebetween. In some embodiments, each relatively larger cutting element 114 within the shoulder region 122 is positioned directly radially adjacent a relatively smaller cutting element 114 rotationally trailing the relatively larger cutting element 114. For example, as shown in FIG. 1B, the cutting element 114 identified by the number 23 may be relatively larger than and may be positioned directly radially adjacent the cutting element 114 identified by the number 24, and the cutting element 114 identified by the number 24 may be relatively larger than and may be positioned directly radially adjacent cutting element 114 identified by the number 25.

As shown in FIG. 1B, one or more of the relatively smaller, rotationally trailing cutting elements 114 within the shoulder region 122 may be underexposed with respect to one or more of the relatively larger, rotationally leading cutting elements 114 within the shoulder region 122. By way of non-limiting example, the cutting element 114 identified by the number 24 may be underexposed with respect to the cutting element 114 identified by the number 23, and the cutting element 114 identified by the number 25 may be underexposed with respect to the cutting element 114 identified by the number 24. The degree to which relatively smaller, rotationally trailing cutting elements 114 within the shoulder region 122 are underexposed with respect to relatively larger, rotationally leading cutting elements 114 within the shoulder region 122 at least partially depends on the properties of the subterranean formation to be acted upon by the rotary drill bit 100 (FIG. 1A); a desired ROP for the rotary drill bit 100; the relative sizes, shapes, and spacing (e.g., radial and circumferential separation) of the cutting elements 114 within the shoulder region 122; the quantity of cutting elements 114 within the shoulder region 122; the presence or absence of chamfers on cutting faces of the cutting elements 114 within the shoulder region 122; and backrake angles of the cutting elements 114 within the shoulder region 122. The relatively larger, more highly exposed cutting elements 114 within the shoulder region 122 may apply focused energy applied to the rotary drill bit 100 (FIG. 1A) from weight on bit (WOB) and bit rotation to fracture the subterranean formation, and the relatively smaller, less exposed cutting elements 114 within the shoulder region 122 may clear and widen grooves made in the subterranean formation by the relatively larger, more highly exposed cutting elements 114 within the shoulder region 122. In additional embodiments, one or more rotationally trailing cutting elements 114 within the shoulder region 122 may have the same exposure as one or more rotationally leading cutting elements 114 within the shoulder region 122.

Figure 3:
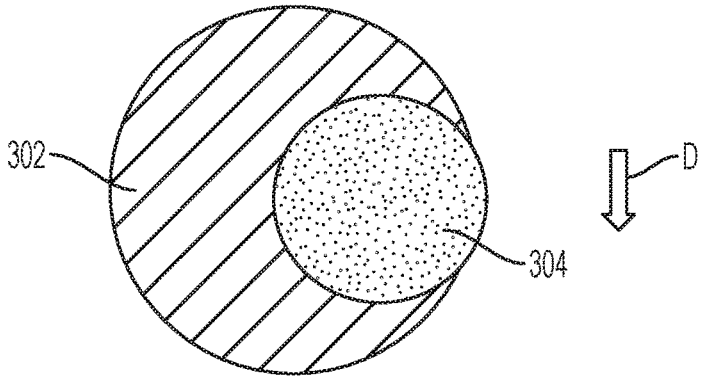
FIGS. 3 through 5 are schematic views of different cutting element exposure configurations, in accordance with embodiments of the disclosure.
Figure 4:
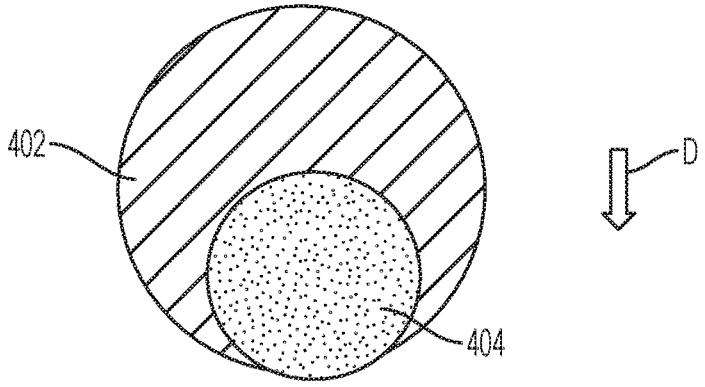
Figure 5:
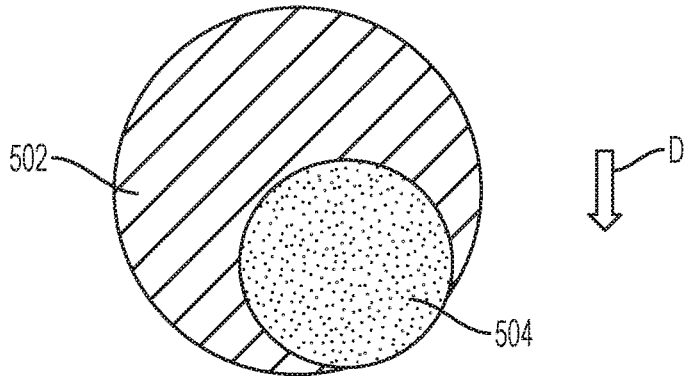

FIGS. 3 through 5 are schematic views showing non-limiting examples of different cutting element exposure configurations that may be present in a shoulder region (e.g., the shoulder region 122 shown in FIG. 1B) of a body (e.g., the body 102 shown in FIG. 1A) of a rotary drill bit (e.g., the rotary drill bit 100 shown in FIG. 1A) according to embodiments of the disclosure. As shown in FIG. 3, in some embodiments, at least one relatively larger cutting element 302 (e.g., corresponding to the cutting element 114 identified by the number 23 in FIG. 1B) and at least one relatively smaller cutting element 304 (e.g., corresponding to the cutting element 114 identified by the number 24 in FIG. 1B) are radially positioned relative to one another such that rotational paths for the relatively larger cutting element 302 and the relatively smaller cutting element 304 during drilling in the direction D overlap one another proximate outermost lateral boundaries of the rotational paths. As shown in FIG. 4, in additional embodiments, at least one relatively larger cutting element 402 (e.g., corresponding to the cutting element 114 identified by the number 23 in FIG. 1B) and at least one relatively smaller cutting element 404 (e.g., corresponding to the cutting element 114 identified by the number 24 in FIG. 1B) are radially positioned relative to one another such that rotational paths for the larger cutting element 402 and the smaller cutting element 404 during drilling in the direction D overlap one another proximate lowermost longitudinal boundaries of the rotational paths. As shown in FIG. 5, in further embodiments, at least one relatively larger cutting element 502 (e.g., corresponding to the cutting element 114 identified by the number 23 in FIG. 1B) and at least one relatively smaller cutting element 504 (e.g., corresponding to the cutting element 114 identified by the number 24 in FIG. 1B) are radially positioned relative to one another within the shoulder region such that rotational paths for the larger cutting element 502 and the smaller cutting element 504 during drilling in the direction D overlap one another at a location intermediate between outermost lateral boundaries and lowermost longitudinal boundaries of the rotational paths.

Figure 6:
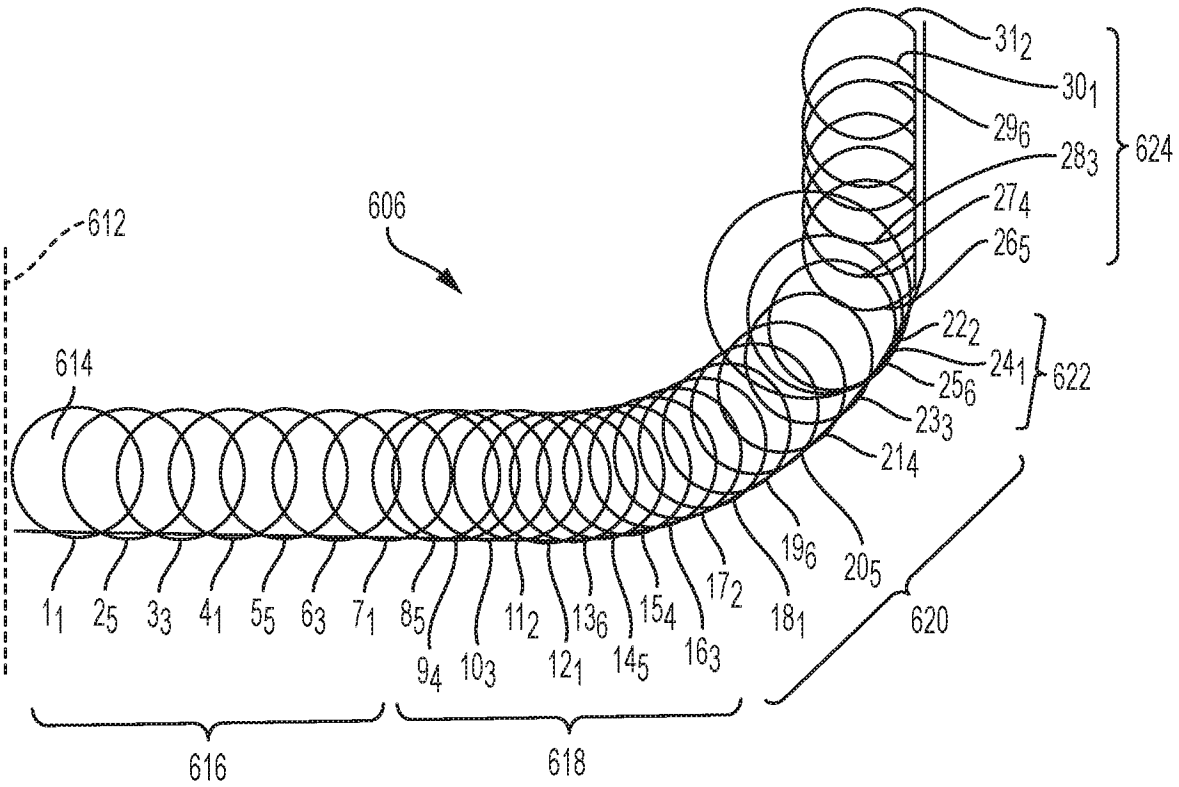
FIG. 6 is a cutter and blade profile of a rotary drill bit, in accordance with a further embodiment of the disclosure.

Returning briefly to FIGS. 1A and 1B, in additional embodiments, at least one relatively larger cutting element 114 within the shoulder region 122 (FIG. 1B) is provided at a position that rotationally trails at least one relatively smaller cutting element 114 within the shoulder region 122 during use and operation of the rotary drill bit 100 (FIG. 1A). By way of non-limiting example, FIG. 6 shows a cutter and blade profile for a rotary drill bit in accordance with additional embodiments of the disclosure. To avoid repetition, not all features shown in FIG. 6 are described in detail herein. Rather, unless described otherwise below, features designated by a reference numeral that is a 100 increment of the reference numeral of a feature described previously in relation to one or more of FIGS. 1A and 1B will be understood to be substantially similar to the feature described previously. As shown in FIG. 6, in some embodiments, at least one cutting element 614 within a shoulder region 622 exhibiting a relatively smaller size (e.g., a relatively smaller diameter, a relatively smaller lateral extent) is provided at a position that rotationally leads a position of at least one other of the cutting elements 614 within the shoulder region 622 exhibiting a relatively larger size (e.g., a relatively larger diameter, a relatively larger lateral extent). By way of non-limiting example, the cutting element 614 identified by the number 22 may be relatively smaller than and may rotationally lead the cutting element 614 identified by the number 24, and the cutting element 614 identified by the number 24 may be relatively smaller than and may rotationally lead the cutting element 614 identified by the number 25. Each relatively smaller cutting element 614 within the shoulder region 622 may be positioned directly radially adjacent a relatively larger cutting element 614 rotationally trailing the relatively smaller cutting element 614; or at least one relatively smaller cutting element 614 within the shoulder region 622 may be radially separated from at least one relatively larger cutting element 614 rotationally trailing the relatively smaller cutting element 614 by at least one other cutting element 614 exhibiting a size less than or equal to that of the relatively smaller cutting element 614.

With continued reference to FIG. 6, one or more of the relatively larger, rotationally trailing cutting elements 614 within the shoulder region 622 may be underexposed with respect to one or more of the relatively smaller, rotationally leading cutting elements 614 within the shoulder region 622. By way of non-limiting example, the cutting element 614 identified by the number 24 rotationally trailing and relatively larger than the cutting element 614 identified by the number 22 may be underexposed with respect to the cutting element 614 identified by the number 22, and the cutting element 614 identified by the number 25 rotationally trailing and relatively larger than the cutting element 614 identified by the number 24 may be underexposed with respect to the cutting element 614 identified by the number 24. The degree to which relatively larger, rotationally trailing cutting elements 614 within the shoulder region 622 are underexposed with respect to relatively smaller, rotationally leading cutting elements 614 within the shoulder region 622 at least partially depends on the properties of the subterranean formation to be acted upon by the rotary drill bit; a desired ROP for the rotary drill bit; the relative sizes, shapes, and spacing (e.g., radial and circumferential separation) of the cutting elements 614 within the shoulder region 622; the quantity of cutting elements 614 within the shoulder region 622; the presence or absence of chamfers on cutting faces of the cutting elements 614 within the shoulder region 622; and backrake angles of the cutting elements 614 within the shoulder region 622. The relatively smaller, more highly exposed cutting elements 614 within the shoulder region 622 may apply focused energy applied to the rotary drill bit from WOB and bit rotation to fracture the subterranean formation, and the relatively larger, less exposed cutting elements 614 within the shoulder region 622 may clear and widen grooves made in the subterranean formation by the relatively smaller, more highly exposed cutting elements 614 within the shoulder region 622. In additional embodiments, one or more rotationally trailing cutting elements 614 within the shoulder region 622 may have the same exposure as one or more rotationally leading cutting elements 614 within the shoulder region 622.

In use and operation, a rotary drill bit according to an embodiment of the disclosure (e.g., the rotary drill bit 100) may be rotated about its rotational axis (e.g., the rotational axis 112, 212, 612) in a borehole extending into a subterranean formation. As the rotary drill bit rotates under applied WOB, at least some of the cutting elements thereof (e.g., at least some of the cutting elements 114, 214, 614) provided in rotationally leading positions across the body of the rotary drill bit engage surfaces of the borehole and cut e.g., shear, gouge, crush, abrade) portions of the subterranean formation, forming grooves in the subterranean formation. Additional cutting elements provided in rotationally trailing positions may then follow and enlarge the grooves formed by the rotationally leading cutting elements. The cutting elements provided in the shoulder region (e.g., the shoulder region 122, 222, 622) of the body of the rotary drill bit may share the work of forming and/or enlarging the outermost diameter of the borehole through the formation and/or enlargement of such grooves.

Figure 7:
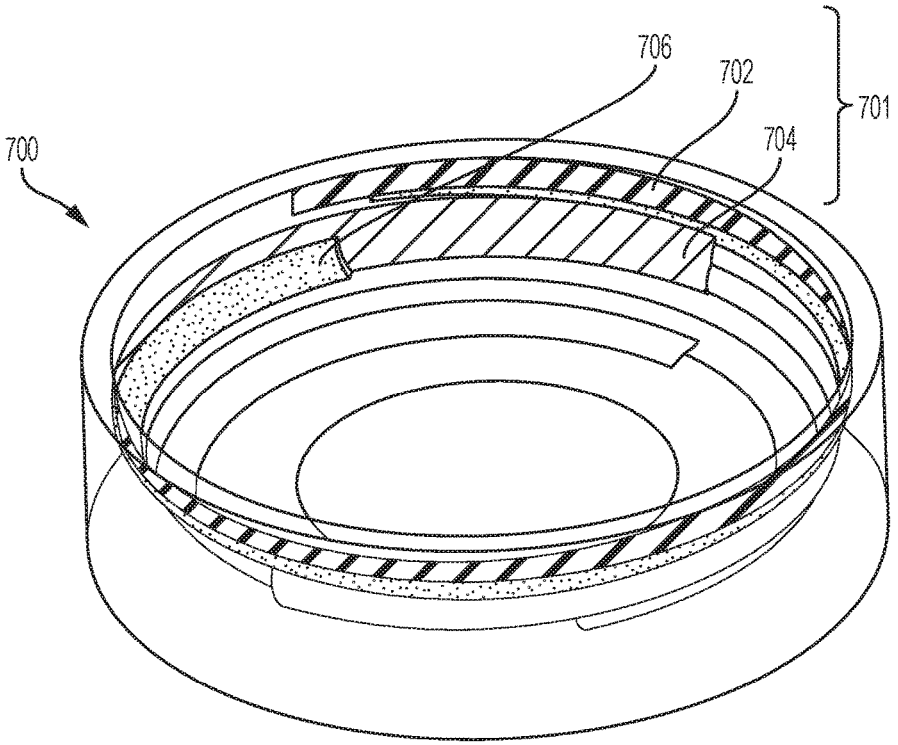
FIG. 7 is a perspective view of a segment of a borehole formed in a subterranean formation using a rotary drill bit having the cutter and blade profile shown in FIG. 1B.

FIG. 7 shows a perspective view of a segment of a borehole 700 that may be formed in a subterranean formation using a rotary drill bit according to embodiments of the disclosure. The borehole 700 may, for example, be formed in the subterranean formation using a rotary drill bit (e.g., the rotatory drill bit 100 shown in FIG. 1A) having the cutter and blade profile shown in FIG. 1B. As shown in FIG. 7, the borehole 700 may exhibit an overall lateral groove 701 at least partially defining an outmost diameter of the borehole 700 and formed from a first groove 702, a second groove 704, and a third groove 706. The second groove 704 may overlap the first groove 702, and the third groove 706 may overlap one or more of the first groove 702 and the second groove 704. Referring collectively to FIGS. 1B and 7, the first groove 702, the second groove 704, and the third groove 706 may respectively be formed by the cutting elements 114 (FIG. 1B) identified by the numbers 23, 24, and 25 (FIG. 1B) within the shoulder region 122 (FIG. 1B) of the body 102 (FIG. 1A) of the rotary drill bit 100 (FIG. 1A). During the formation of the borehole 700, the relatively larger, rotationally leading cutting element 114 identified by the number 23 may fracture the subterranean formation to form the first groove 702, the relatively smaller cutting element 114 identified by the number 24 may fracture a remaining portion of the subterranean formation surrounding the first groove 702 to form the second groove 704, and then the even relatively smaller cutting element 114 identified by the number 25 may fracture a further remaining portion of the subterranean formation surrounding the first groove 702 and/or the second groove 704 to form the third groove 706. Accordingly, the second groove 704 may widen and refine the first groove 702, and the third groove 706 may further widen and refine the widened groove formed from the first groove 702 and the second groove 704 to form the overall lateral groove 701.

Figure 8:
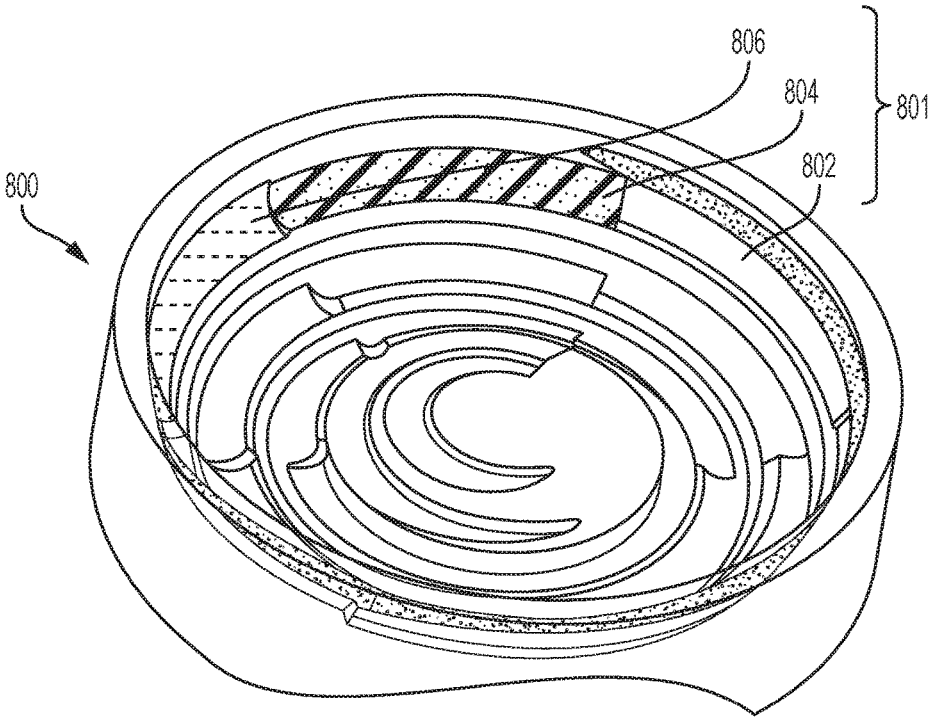
FIG. 8 is a perspective view of a segment of a borehole formed in a subterranean formation using a rotary drill bit having the cutter and blade profile shown in FIG. 6.

FIG. 8 shows a perspective view of a segment of a borehole 800 that may be formed in a subterranean formation using a rotary drill bit according to additional embodiments of the disclosure. The borehole 800 may, for example, be formed in the subterranean formation using a rotary drill bit having the cutter and blade profile shown in FIG. 6. As shown in FIG. 8, the borehole 800 may exhibit an overall lateral groove 801 at least partially defining an outmost diameter of the borehole 800 and formed from a first groove 802, a second groove 804, and a third groove 806. The second groove 804 may overlap the first groove 802, and the third groove 806 may overlap one or more of the first groove 802 and the second groove 804. Referring collectively to FIGS. 6 and 8, the first groove 802, the second groove 804, and a third groove 806 may respectively be formed by the cutting elements 614 (FIG. 6) identified by the numbers 22, 24, and 25 (FIG. 6) within the shoulder region 622 (FIG. 6) of a body of the rotary drill bit. During the formation of the borehole 800, the relatively smaller, rotationally leading cutting element 614 identified by the number 22 may fracture the subterranean formation to form the first groove 802, the relatively larger cutting element 614 identified by the number 24 may fracture a remaining portion of the subterranean formation surrounding the first groove 802 to form the second groove 804, and then even relatively larger cutting element 614 identified by the number 25 may fracture a further remaining portion of the subterranean formation surrounding the first groove 802 and/or the second groove 804 to form the third groove 806. Accordingly, the second groove 804 may widen and refine the first groove 802, and the third groove 806 may further widen and refine the widened groove formed from the first groove 802 and the second groove 804 to form the overall lateral groove 801.

The apparatuses and methods according to embodiments of the disclosure advantageously facilitate the efficient formation of boreholes exhibiting desirable outer diameters in a subterranean formation. The cutting element configurations (e.g., sizes, shapes, material compositions) and layouts (e.g., positions, spacing) of the disclosure permit cutting elements (e.g., the cutting elements 114, 214, 614) positioned within a shoulder region (e.g., the shoulder regions 122, 222, 622) of a body of a rotary drill bit (e.g., the rotary drill bit 100) to share the work of forming the outer diameter of a borehole, more evenly distributing damage across the cutting elements, and extending operational life of the rotary drill bit as compared to conventional rotary drill bits including conventional cutting element configurations and layouts.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. The scope of the invention, as exemplified by the various embodiments of the present disclosure, is limited only by the claims which follow, and their legal equivalents.

What is claimed is:

1. An earth-boring tool, comprising:

a body having a face at a leading end thereof and comprising a cone region, a nose region, a flank region, a shoulder region, and a gage region;

a plurality of blades extending longitudinally and radially over the face; and cutting elements disposed within the shoulder region of the body on different blades of the plurality of blades than one another, a first of the cutting elements on a first of the plurality of blades exhibiting a larger diameter than a second of the cutting elements directly radially adjacent the first of the cutting elements and on a second of the plurality of blades rotationally trailing the first of the plurality of blades; and additional cutting elements located within one or more of the cone region, the nose region, the flank region, and the gage region of the body, at least some of the cutting elements exhibiting a larger size than any of the additional cutting elements.

2. The earth-boring tool of claim 1, wherein a third of the cutting elements directly radially adjacent the second of the cutting elements is provided on a third of the plurality of blades rotationally trailing the second of the plurality of blades and exhibits a smaller size than the second of the cutting elements.

3. The earth-boring tool of claim 1, wherein a size ratio of the first of the cutting elements to the second of the cutting elements is within a range of from 0.32:1 to 0.84:1.

4. The earth-boring tool of claim 1, wherein the first of the cutting elements and the second of the cutting elements exhibit different sizes selected from the group consisting of 8 mm, 11 mm, 13 mm, 16 mm, 19 mm, and 25 mm.

5. The earth-boring tool of claim 1, wherein at least one of the cutting elements exhibits a different shape than at least one other of the cutting elements.

6. The earth-boring tool of claim 1, wherein the second of the cutting elements is underexposed with respect to the first of the cutting elements.

7. The earth-boring tool of claim 1, wherein the cutting elements are disposed on the different blades of the plurality of blades in a first spiral configuration and the additional cutting elements are disposed on at least some of the plurality of blades in a second spiral configuration opposite the first spiral configuration.

8. The earth-boring tool of claim 7, wherein the first spiral configuration is a forward spiral configuration and the second spiral configuration is a reverse spiral configuration.

9. The earth-boring tool of claim 1, wherein the shoulder region of the body exhibits only one group of the cutting elements radially positioned relative to one another such that rotational paths of the cutting elements at least partially overlap one another.

10. The earth-boring tool of claim 9, wherein a quantity of the cutting elements in the group of the cutting elements is less than or equal to a quantity of the different blades in the plurality of blades.

11. The earth-boring tool of claim 9, wherein the group of the cutting elements consists of three of the cutting elements.

12. The earth-boring tool of claim 9, wherein each of the cutting elements in the shoulder region of the body exhibits a different diameter than each other of the cutting elements in the shoulder region of the body.

13. An earth-boring tool, comprising:

a body having a face at a leading end thereof and comprising a cone region, a nose region, a flank region, a shoulder region, and a gage region;

a plurality of blades extending longitudinally and radially over the face; and cutting elements disposed within the shoulder region of the body on different blades of the plurality of blades than one another, a first of the cutting elements on a first of the plurality of blades exhibiting a larger diameter than a second of the cutting elements directly radially adjacent the first of the cutting elements and on a second of the plurality of blades rotationally trailing the first of the plurality of blades; and additional cutting elements located within one or more of the cone region, the nose region, the flank region, and the gage region of the body, each of the additional cutting elements exhibiting substantially the same size.

14. A method of forming an earth-boring tool, comprising:

forming a body having a face at a leading end thereof and comprising a cone region, a nose region, a flank region, a shoulder region, and a gage region;

disposing a first cutting element within the shoulder region of the body on a first blade extending longitudinally and radially over the face;

disposing a second cutting element within the shoulder region of the body on a second blade extending longitudinally and radially over the face and rotationally trailing the first blade, the second cutting element directly radially adjacent the first cutting element and exhibiting a smaller diameter than the first cutting element; and disposing additional cutting elements within one or more of the cone region, the nose region, the flank region, and the gage region of the body, one or more of the first cutting element and the second cutting element exhibiting a larger size than any of the additional cutting elements.

15. The method of claim 14, further comprising disposing a third cutting element within the shoulder region of the body on a third blade extending longitudinally and radially over the face and rotationally trailing the second blade, the third cutting element directly radially adjacent the second cutting element and exhibiting a smaller diameter than each of the first cutting element and the second cutting element.

16. The method of claim 14, wherein disposing a second cutting element within the shoulder region of the body on a second blade comprises disposing the second cutting element at a different radial position within the shoulder region of the body than the first cutting element.

17. A method of forming a borehole in a subterranean formation, comprising:

disposing an earth-boring tool at a distal end of a drill string in a borehole in a subterranean formation, the earth-boring tool comprising:

a body having a face at a leading end thereof and comprising a cone region, a nose region, a flank region, a shoulder region, and a gage region;

a plurality of blades extending longitudinally and radially over the face;

cutting elements disposed within the shoulder region of the body on different blades of the plurality of blades than one another, a first of the cutting elements on a first of the plurality of blades exhibiting a larger diameter than a second of the cutting elements directly radially adjacent the first of the cutting elements and on a second of the plurality of blades rotationally trailing the first of the plurality of blades; and additional cutting elements located within one or more of the cone region, the nose region, the flank region, and the gage region of the body, at least some of the cutting elements exhibiting a larger size than any of the additional cutting elements;

applying weight on bit to the earth-boring tool through the drill string to contact the formation while rotating the earth-boring tool; and engaging the subterranean formation with the cutting elements of the rotating earth-boring tool.

* * * * *